US010164381B2

(12) United States Patent
Fuessl et al.

(10) Patent No.: US 10,164,381 B2
(45) Date of Patent: Dec. 25, 2018

(54) PLUG-IN FUSE ELEMENT

(71) Applicant: Lisa Draexlmaier GmbH, Vilsbiburg (DE)

(72) Inventors: Peter Fuessl, Vilsbiburg (DE); Christian Wimmer, Gerzen (DE); Robert Saller, Egglkofen (DE); Michael Wortberg, Dorfen (DE); Klaus Specht, Geisenhausen (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/196,953

(22) Filed: Jun. 29, 2016

(65) Prior Publication Data

US 2017/0004945 A1 Jan. 5, 2017

(30) Foreign Application Priority Data

Jul. 1, 2015 (DE) ..... 10 2015 110 593

(51) Int. Cl.

| | |
|---|---|
| ***H01H 85/044*** | (2006.01) |
| ***H01H 85/20*** | (2006.01) |
| ***H01R 13/68*** | (2011.01) |
| ***H01H 85/153*** | (2006.01) |

(52) U.S. Cl.
CPC ..... *H01R 13/68* (2013.01); *H01H 85/153* (2013.01); *H01H 85/201* (2013.01)

(58) Field of Classification Search
CPC ..... H01H 85/153; H01H 85/201; H01R 13/68
USPC ..... 337/191
See application file for complete search history.

(56) References Cited

U.S. PATENT DOCUMENTS 4,372,638 A * 2/1983 Sohler ..... H01H 85/2035 337/251
4,789,361 A * 12/1988 Kinzalow ..... H01R 13/68 337/209
4,827,238 A * 5/1989 Kozel ..... H01H 85/26 337/255
4,830,631 A * 5/1989 Hsueh ..... H01H 85/2035 337/187
4,842,534 A * 6/1989 Mobley ..... H01H 85/2035 337/191

(Continued)

FOREIGN PATENT DOCUMENTS

DE 10 2004 060 099 B3 5/2006
DE 10 2006 024 391 A1 11/2007

(Continued)

*Primary Examiner* — Anatoly Vortman
(74) *Attorney, Agent, or Firm* — Finnegan, Henderson, Farabow, Garrett & Dunner, LLP

(57) ABSTRACT

Embodiments disclose a plug-in fuse element comprising a strip-shaped sheet metal part having a first end section, a second end section, and an interposed center section, wherein the first end section is a flat plug-in contact; the second end section is a connecting region configured to connect to a stranded conductor, and the center section is an overcurrent protection device. In some embodiments, a stranded conductor is connected on at least one end to a connecting region of at least one plug-in fuse element. In some embodiments, a wiring system includes at least one stranded conductor connected via a flat plug-in contact of a plug-in fuse element to a flat conductor. In some embodiments, a vehicle comprises the at least one wiring system.

20 Claims, 5 Drawing Sheets

(56) References Cited

U.S. PATENT DOCUMENTS 4,884,050 A * 11/1989 Kozel ..... H01H 85/0417 337/255
4,941,851 A * 7/1990 Hsueh ..... H01R 13/68 337/187
4,986,767 A * 1/1991 Kozel ..... H01H 85/2035 337/255
5,082,452 A * 1/1992 Takano ..... H01H 85/202 439/206
5,324,214 A * 6/1994 De Castro ..... B60R 16/02 439/620.26
5,476,396 A * 12/1995 De Castro ..... B60R 16/02 439/620.31
5,882,229 A * 3/1999 Caren ..... H01H 85/0417 439/620.26
5,898,357 A * 4/1999 Endo ..... H01H 85/11 337/159
6,376,774 B1 * 4/2002 Oh ..... H01H 85/10 174/92
6,806,806 B2 * 10/2004 Anthony ..... H01C 7/021 333/12
7,532,102 B2 * 5/2009 Lu ..... H01H 85/0417 337/191
7,828,610 B2 * 11/2010 Lehmann ..... H01R 4/187 29/860
2005/0014408 A1 * 1/2005 Swiatek ..... B62J 99/00 439/215
2008/0042795 A1 2/2008 Fussl et al.
2009/0001812 A1 * 1/2009 Brooks ..... H01H 85/0417 307/10.1
2009/0002812 A1 1/2009 Kuster
2009/0251274 A1 10/2009 Pavlovic et al.
2015/0263439 A1 * 9/2015 Wortberg ..... H01R 13/04 361/93.8

FOREIGN PATENT DOCUMENTS

DE 10 2007 018 185 A1 12/2007
DE 10 2009 009 934 A1 10/2009
DE 10 2014 003 113 B1 8/2015
JP H 9-139256 A 5/1997
JP H 10-302900 A 11/1998

* cited by examiner

PLUG-IN FUSE ELEMENT

CROSS REFERENCE TO RELATED APPLICATION

This application is based upon and claims the benefit of prior German Patent Application No. 10 2015 110 593.4, filed on Jul. 1, 2015, the entire contents of which are incorporated herein by reference.

TECHNICAL FIELD

The present disclosure relates to a plug-in fuse element comprising an electrical fuse. The present disclosure also relates to a stranded conductor comprising such a plug-in fuse element. The present disclosure further relates to a wiring system comprising at least one such stranded conductor. The present disclosure moreover relates to a vehicle comprising at least one such wiring system. The present disclosure can in particular be applied to electrical circuits in vehicles, such as motor vehicles or aircraft.

BACKGROUND

Due to the increased use of non-conducting material combinations in the vehicle body, all the way to the complete carbon-fiber-reinforced polymers (CFRP) body (such as monocoque) and a wide variety of joining techniques such as adhesive bonding, riveting, welding and the like, the ground return current from a consumer to a battery, which is typically conducted into the body via grounding combs, will be undefined or non-directional in the future. This undefined ground return current may create an electromagnetic field, which can decisively influence, or possibly even harm, vehicle passengers and on-board electronics. As a result, the previously customary electric ground return via the vehicle body is drastically impaired or practically impossible.

This problem may be solved by a ground return when a greater number of stranded conductors is installed. However, this increases the weight of the onboard electrical system or of the wiring harness.

The use of flat conductors for ground return may allow the installation space and the conductor weight to be reduced. The flat conductor is installed along the floor pan contour from a rear compartment to an engine compartment. A flat conductor structure as a central electrical supply unit and ground return additionally eliminates the development of an electric magnetic field independently of the body materials. This flat conductor system in the vehicle moreover achieves improved stability of the on-board electrical system.

Due to the flat design, the individual flat conductors, or flat conductors having a multi-layer composition (multi-rail), have contact elements or contact systems protruding on the side and/or end face so as not to impair adjoining flat conductors. The contact elements or contact systems lead via stranded conductors to respective consumers, such as electrical and/or electronic circuits, such as of an electronic system, a sensor system, an actuator system and the like.

The flat conductors can be protected with respect to the contacted stranded conductors, which can be achieved, for example, by a fusible cutout between the flat conductor and the stranded conductor. A fusible cutout implemented by a cross-sectional (area) reduction can result in drastic temperature increases locally due to a locally increased current density. Avoiding such local temperature concentrations outside of a safety incident has been technologically complex and/or cost-intensive until now.

SUMMARY

Embodiments of the present disclosure provide an option for reducing temperatures on a fuse between two conductors, for example between a flat conductor and a stranded conductor.

Embodiments of the present disclosure provide a plug-in fuse element, comprising a sheet metal part that may be flat, for example strip-shaped, having a first end section, a second end section, and an interposed center section, wherein the first end section is designed as a flat plug-in contact, the second end section is designed as a connecting region for the connection to a stranded conductor, and the center section is designed as a fuse (hereinafter also referred to as an "overcurrent protection device" or "short circuit fuse").

According to embodiments of the present disclosure, the plug-in fuse element has the first end section designed as a flat plug-in contact, or a flat plug-in contact region, to allow a heat transfer across a large surface area from the center section to a wire (such as a flat conductor) connected to the flat plug-in contact to be achieved. In this way, heat can be effectively dissipated from the center section, and thus from the overcurrent protection device, which may increase the service life, for example. Moreover, the connecting region, which can be designed to cover a large surface area, enables effective heat dissipation from the overcurrent protection device to a stranded conductor.

According to embodiments of the present disclosure, the flat plug-in contact also allows reliable and robust electrical contacting. The flat plug-in contact enables contacting a flat conductor, since only a low structural complexity is required for this purpose, for example for flat conductors, the lug- or tab-shaped contact elements of which are disposed on the side or at the end face. Moreover, a flat plug-in system composition and a small installation space may be achieved using more simple means. Conventional, proven joining or process technologies can be employed to produce and connect the plug-in fuse element. In this way, cost-effective contacting with the fuse can be provided.

According to embodiments of the present disclosure, the plug-in fuse element can also be regarded as a fuse having outer sections or end sections that are designed for flat plug-in contacting or for contacting a stranded conductor. The plug-in fuse element can be regarded as a fuse for a stranded conductor having an integrated plug-in contact, or as a plug-in contact for a stranded conductor having an integrated fuse.

According to embodiments of the present disclosure, a "flat" body may be understood to mean a body having a thickness that is considerably (such as by at least a factor of 5 or 10) smaller than the lateral extension thereof (such as the length or width). A strip-shaped sheet metal part may be understood to mean a flat sheet metal part having a length (comprising the end sections and the center section) that is greater than the width.

According to embodiments of the present disclosure, the flat plug-in contact enables a plug-in connection or plug-in contacting between a (male) flat lug or tab and a matching (female) housing ("flat plug-in housing") having a narrow or flat receptacle for the tab. The resultant areal positioning of the tab on top of a matching counter-surface or contact surface in the flat plug-in housing allows heat to more easily dissipated very cost-effectively and very effectively.

According to embodiments of the present disclosure, the sheet metal part is a stamped part. According to some embodiments, the sheet metal part is a pure stamped part (for example, the pure stamped part is not bent). The sheet metal part, however, can also be a stamped/bent part, which still allows a simpler and less expensive production. As an alternative, however, the sheet metal part can be separated using other methods, such as laser cutting.

According to embodiments of the present disclosure, for effective heat dissipation, the lug can be clamped into the flat plug-in housing, for example by way of a locking mechanism. The locking mechanism can press the contact surface of the flat plug-in housing onto the lug, for example after insertion has taken place without force, or with only little force (zero insertion force, ZIF). In some embodiments, for a more reliable (such as vibration-resistant) plug-in connection, the lug is lockable in the flat plug-in housing, for example using a detachable latching engagement or by a clamped fit or press fit using a high contact force. The press fit can be implemented, for example, by a suitable pressing mechanism of the flat plug-in housing.

According to embodiments of the present disclosure, the design of the first end section of the sheet metal part as a flat plug-in contact can generally be implemented by way of the first end section alone, or by way of the first end section and at least one further component attached to the first end section.

According to embodiments of the present disclosure, the design of the second end section as a connecting region for the connection to the stranded conductor can generally be implemented by way of the second end section alone, or by way of the second end section and at least one further component attached to the second end section.

According to embodiments of the present disclosure, the design of the center section as an overcurrent protection device can generally be implemented by way of the center section alone, or by way of the center section and at least one further component attached to the center section.

According to an embodiment, the first end section is designed as a tab. This can be provided by way of a stamping process, for example. The tab can be inserted into a flat plug-in housing of a conductor element, such as a flat conductor, to be contacted with the plug-in fuse element. In this design, the flat plug-in contact of the plug-in fuse element is thus designed as a male contact element of a flat plug-in connection.

According to some embodiments, a flat plug-in housing is attached (as a further component of the flat plug-in contact) to the first end section by way of at least one areal contact, or areal contact region (i.e., not only in certain spots). The flat plug-in contact is thus formed jointly by the flat plug-in housing and the first end section serving as the carrier of the flat plug-in housing. In this way, for example, a flat conductor may be contacted with the flat plug-in contact in that the flat conductor is designed with a tab, which can be inserted into the flat plug-in housing of the plug-in fuse element. This allows a more simple and cost-effective production and a more robust design of the flat conductor. In this design, the flat plug-in contact of the plug-in fuse element is thus designed as a female contact element of a flat plug-in connection.

According to embodiments of the present disclosure, for effective heat dissipation, the flat plug-in housing may be connected via a planar, areal contact to the first end section, directly or without further intermediate elements. This may provide easier sealability of the tab of the flat conductor by insert molding the same, up to the contact surface of the stud, so as to be electrically insulated and sealed against media.

According to embodiments of the present disclosure, it is possible to replace a conductor when the flat plug-in housing fails, such as by breaking away the contact lamellae, without having to remove the flat conductors, which in some instances are very long.

Embodiments of the present disclosure may provide an increased heat dissipation from the protective section or center section by the flat plug-in housing.

According to embodiments of the present disclosure, the flat plug-in housing may be joined to the first end section of the sheet metal part, for example by way of press-joining (also referred to as "clinching" or "toxing"). In this way, the production process of the plug-in contact housing would be decoupled from the fusible cut-out and the differing materials, processes and cycle times thereof. The plug-in fuse element (for example, the flat plug-in housing and sheet metal part thereof) can thus be assembled from multiple pieces or in a modular fashion.

According to some embodiments, at least one cooling projection is present on the plug-in fuse element, for example on the sheet metal part thereof (for example, on the first end section and/or on the second end section and/or on the center section). This may improve a heat dissipation from the center section or from the fuse.

According to some embodiments, the at least one cooling projection comprises at least one bent region extending laterally from the sheet metal part, or is such a region. The sheet metal part can be produced as a stamped/bent part, for example. For example, these regions may be bent vertically.

According to some embodiments, as an alternative or in addition, at least one separately produced heat sink can be disposed on the plug-in fuse element, and on the sheet metal part thereof.

According to some embodiments, the at least one cooling projection can be designed, for example, as at least one cooling rib, cooling fin, cooling pin and the like.

According to some embodiments, to improve the heat dissipation, the sheet metal part, and in particular the first end section and/or the second end section, is connected to at least one heat removal line. The heat removal line can be designed as a heat removal cable, for example.

According to some embodiments, the center section has a cross-sectional taper that is deliberately formed as a fusible cutout. In this way, the overcurrent protection device can be produced without further complexity, or without further components, for example as a simple stamped section.

According to some embodiments, the center section comprises at least one further component for forming the overcurrent protection device, or the overcurrent protection device is formed by the center section of the sheet metal part and at least one further component. The at least one further component may be produced separately and attached to the center section. The center section may be tapered or not tapered.

According to some embodiments, the at least one further component comprises at least one fusible cutout element (such as a soldered-on or glued-on fusible cutout element).

According to some embodiments, the fuse is a pyrotechnic fuse. The at least one further component can then be a housing comprising a blasting cap, for example.

According to some embodiments, the fuse associated with the center section is an electronic fuse or a semiconductor fuse. The electronic fuse can be designed in a current flow-regulating or current flow-switching manner. This can comprise at least one passive (for example, autonomous) switch element or at least one active switch element as at least one further component, which can be connected to an additional signal line for controlling/regulating the flow of current. At least the passive or active switch element can be fastened to the center section. The electronic fuse can comprise a microcontroller, FPGA, ASIC and the like, for example, or be connected to such.

According to some embodiments, at least the center section (and possibly abutting sub-regions of the first end section and/or of the second end section) or at least the overcurrent protection device is surrounded by a housing. The housing protects the center section or the fuse, for example by way of sealing from external influences such as harmful media. Moreover, this can bring about a mechanical reinforcement of the plug-in fuse element. The housing may also be used or designed for positioning or fixation, for example by forming a detent element. Moreover, the housing may be used or designed as a guide for inserting the first section. The housing may also represent a functional portion of the overcurrent protection device.

According to some embodiments, the housing is a thermally conductive housing, which improves a heat dissipation from the center section and/or from at least one of the end sections of the sheet metal part.

According to some embodiments, the housing can be a plastic housing, for example, a galvanically coated plastic housing and/or a plastic housing produced from thermally conductive plastic material.

According to some embodiments, the strip-shaped sheet metal part comprises two outer layers made of differing metals, a contact region of the flat plug-in contact being formed via one of the outer layers, and the connecting region being formed via the other outer layer. In this way, good contacting of the plug-in fuse element on the end sections with conductors made of differing materials can be achieved.

According to some embodiments, a sheet metal part of the plug-in fuse element designed as an AI-Cu two-layer sheet may be plug-connected with the outside thereof made of aluminum (or an aluminum alloy) to a flat conductor made of aluminum (or an aluminum alloy), and with the outside thereof made of copper (or a copper alloy) to a cable lug or wires made of copper (or a copper alloy) of the stranded conductor. The Al—Cu two-layer sheet can have been separated from rolled aluminum-copper sheet metal, for example, such as stamped out or cut out.

The strip-shaped sheet metal part can in general comprise at least one intermediate layer between the two outer layers and can be used accordingly.

According to some embodiments, a transition region of the multi-layer sheet metal part between two different materials is sealed against media influence to prevent possible electrochemical corrosion. For this purpose, the sheet metal part can be galvanically sealed or polymer-coated at least in this region, for example.

According to some embodiments, the plug-in fuse element comprises at least one electrical filter, such as a frequency filter. In this way, interfering magnetic and/or electric fields of the contacted stranded conductors can be drastically reduced, and thus electromagnetic compatibility (EMC) can be considerably improved.

According to embodiments of the present disclosure, a stranded conductor, which is mechanically and electrically connected on at least one end to a connecting region of the plug-in fuse element as described above. The stranded conductor can be designed analogously to the plug-in fuse element. In this way, the stranded conductor is equipped with a plug-in fuse element on at least one end. The plug-in fuse element can then also be regarded as an end piece of the stranded conductor. The plug-in fuse element is fixedly connected via the connecting region thereof, or via the second end section of the sheet metal part, to at least one wire of the stranded conductor, either directly or indirectly (such as via an intermediate element).

According to embodiments of the present disclosure, the at least one wire can generally be connected to the connecting region in an integral manner (such as soldered-on or welded-on) and/or in a force-fit manner (such as clamped-on or crimped) and/or in a form-locked manner (such as twisted or crimped).

According to embodiments of the present disclosure, the stranded conductor per se can comprise one lead (including one or more wires) or multiple leads (each including one or more wires).

For example, the stranded conductor can be connected at the other end thereof to a consumer, for example an electrical and/or electronic circuit, such as of an electronic system, a sensor system, an actuator system and the like.

According to some embodiments, at least one strand of the stranded conductor is connected to a cable lug, and the cable lug is connected for example via an areal contact to the second end section of the sheet metal part, or to the connecting region of the plug-in fuse element.

According to some embodiments, at least one strand of the stranded conductor is connected directly to the second end section, such as by way of a solder connection, a crimp connection, or a laser or ultrasonic weld joint.

According to embodiments of the present disclosure, a wiring system in which a stranded conductor, as described above, is connected via the flat plug-in contact of the plug-in fuse element to a flat conductor. Such a wiring system can have a flat and compact design. For example, it may only be needed to replace the stranded conductor (together with the associated plug-in fuse element), or even only the plug-in fuse element, and not the flat conductor, when a fuse blows.

According to embodiments of the present disclosure, the flat conductor is an aluminum flat conductor rail. The flat conductor can have a one-piece or multi-piece (which is to say joined from multiple separately produced parts) design.

According to embodiments of the present disclosure, a vehicle is provided comprising at least one plug-in fuse element as described above, at least one stranded conductor (comprising an associated plug-in fuse element) as described above and/or a wiring system as described above.

According to embodiments of the present disclosure, the vehicle is a motor vehicle (such as a passenger car, a truck, a bus and the like) or an aircraft (such as an airplane, a helicopter and the like).

According to embodiments of the present disclosure, when an aluminum flat conductor rail is used as the flat conductor, moreover a space-saving and simple option for ground return can be provided, even in the case of bodies made to a high degree, or practically entirely, of non-metals.

According to embodiments of the present disclosure, the aluminum flat conductor rail is installed along a floor pan contour from a rear compartment to an engine compartment of the vehicle.

The described properties of the present disclosure and the manner in which these are achieved will be described in more detail based on the following detailed description. The foregoing general description and the following detailed description are exemplary and explanatory only, and are not restrictive of embodiments consistent with the present disclosure. Further, the accompanying drawings illustrate embodiments of the present disclosure, and together with the description, serve to explain principles of the present disclosure.

DETAILED DESCRIPTION

Figure 1A:
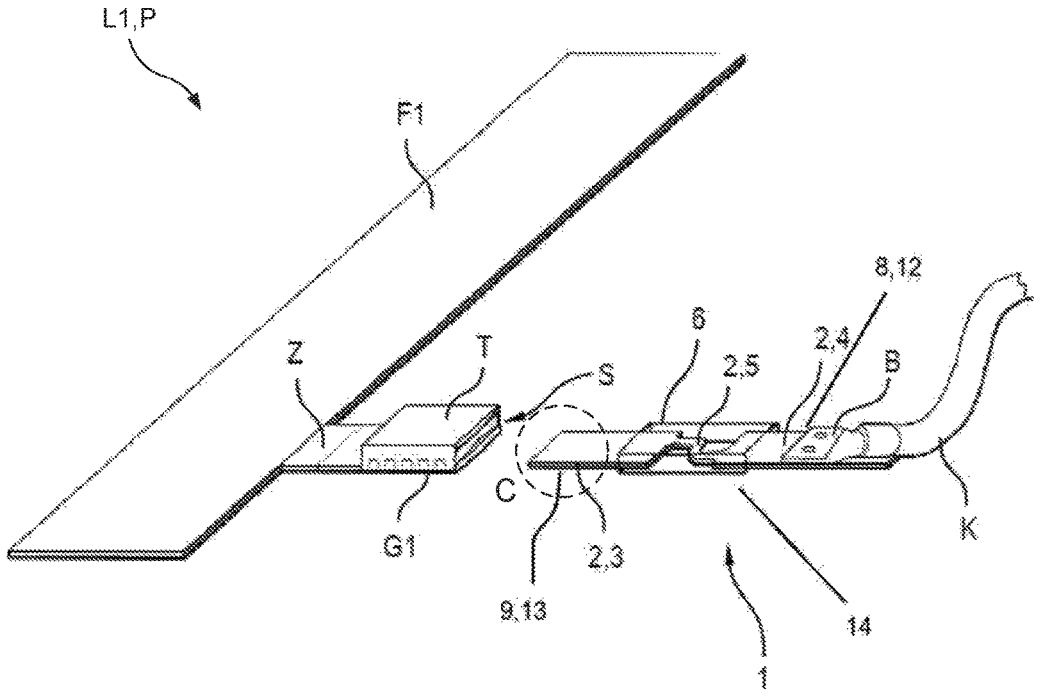
FIGS. 1A-B show an oblique view and a magnified view, respectively, of a section of a wiring system of a vehicle according to a first exemplary embodiment comprising a plug-in fuse element.

FIG. 1A shows an oblique view of a section of a wiring system L1 of a vehicle in the form of a motor vehicle P, for example. The wiring system L1 comprises a strip-shaped flat conductor F1, which can extend, for example, along a floor pan contour (not shown) from an rear compartment (not shown) to an engine compartment (not shown) of the motor vehicle P, and can be made of aluminum or an aluminum alloy, for example. Such a flat conductor F1 can also be referred to as a flat conductor rail. In the engine compartment, the flat conductor F1 can be connected to a battery, for example.

The flat conductor F1 can comprise one or more lateral flat plug-in contacts, of which one flat plug-in contact is shown here in the form of a (female) flat plug-in housing G1.

The flat plug-in housing G1 comprises a laterally projecting tab Z of the flat conductor F1, which at the end comprises additional components, such as a further housing part T, a clamping mechanism (not shown), and the like. The tab Z provides a contact region with a male flat plug-in contact to be inserted into the flat plug-in housing G1. The flat plug-in contact is to be inserted into a slot-shaped insertion opening S of the flat plug-in housing G1 for establishing a plug connection. The flat plug-in housing G1 can be designed as a ZIF housing and retain, and essentially lock, the flat plug-in contact, such as by a selectively released and retaining clamping or pressing mechanism (not shown).

Figure 2:
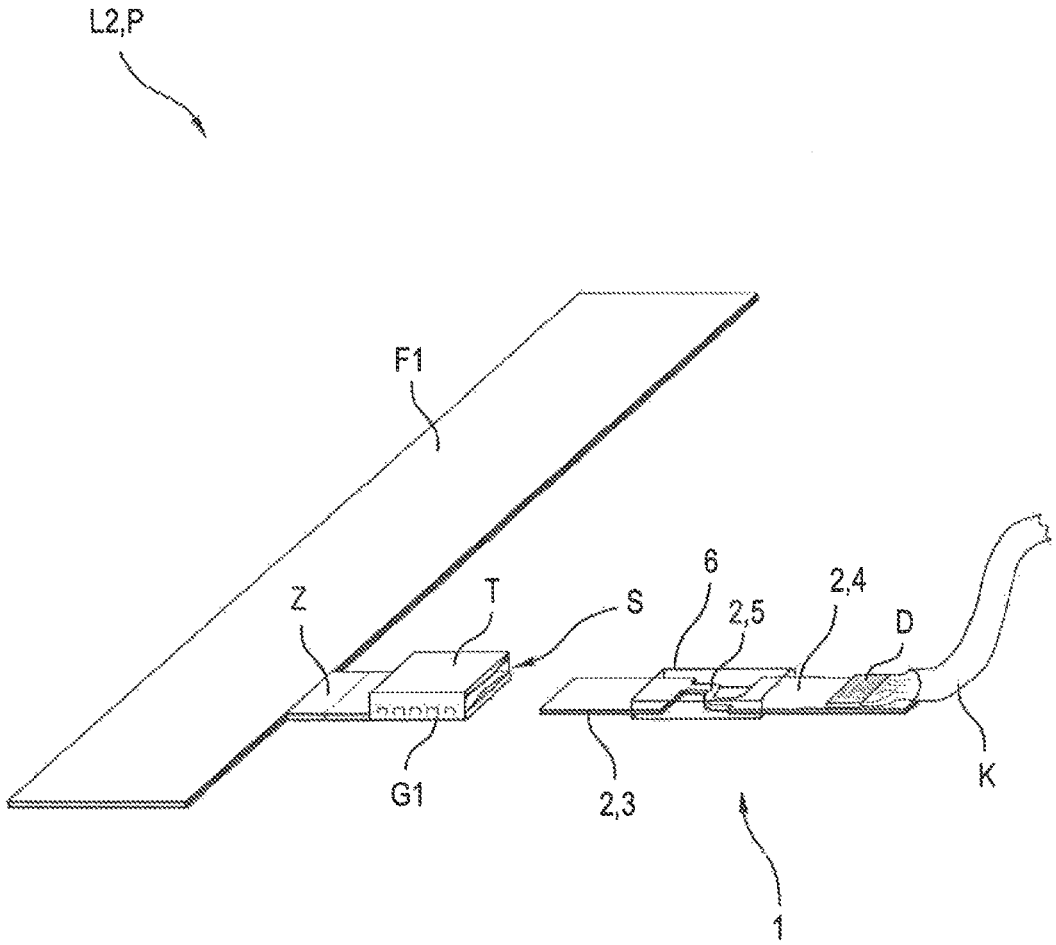
FIG. 2 shows an oblique view of a section of a wiring system of a vehicle according to a second exemplary embodiment comprising a plug-in fuse element.

The wiring system L1 furthermore comprises a stranded conductor in the form of a cable K comprising at least one metal wire D (see FIG. 2). The cable K is connected at the remote end thereof (not shown) to a consumer (not shown) and is to be connected at the shown near end thereof to the flat conductor F1 so as to enable a defined electrical ground return. For this purpose, the cable K is equipped at the shown near end with a plug-in fuse element 1, which forms both an overcurrent protection device as well as the male flat plug-in contact for insertion into the flat plug-in housing G1.

For this purpose, the plug-in fuse element 1 comprises a substantially strip-shaped sheet metal part 2 having a first end section 3, a second end section 4, and an interposed center section 5. The first end section 2 is designed as a simple tab, which alone serves as the male flat plug-in contact and can be inserted into the slot-shaped insertion opening S of the flat plug-in housing G1.

The second end section 4 is designed as an areal connecting region for the connection to the cable K. For this purpose, the near end of the cable K is equipped with a cable lug B made of copper, which is connected to the second end section 4 in an areal and fixed manner (for example, form-fitting), for example by way of press-joining.

The center section 5 is designed as an overcurrent protection device, and for this purpose has a drastically tapered, and in this example curved, cross-sectional shape. The center section 5 is thus designed as a fusible element or fusible cutout.

For its protection and for its mechanical reinforcement, the center section 5 is surrounded by a thermally conductive housing 6 (for example, coated with metal or made of a thermally conductive plastic material), which also holds regions of the first end section 3 and of the second end section 4 connecting thereto. The housing 6, together with the center section 5, can represent a functional component of the overcurrent protection device.

Figure 1B:
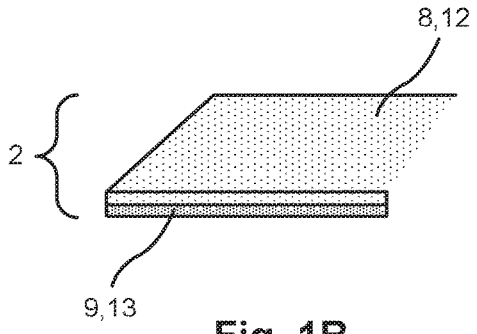

The sheet metal part 2 can be designed as a bimetallic strip having an outer layer 8 made of copper on the upper face 12 and an outer layer 9 made of aluminum on the lower face 13 here, by way of example (see also FIG. 1B, showing a magnified view of section C in FIG. 1A). At the second end section 4, the upper face 12 made of copper can be connected in an areal manner to the copper cable lug B, while the lower face 13 made of aluminum on the first end section 3 is held in areal contact with the tab Z, which is made of aluminum, of the flat conductor F1.

Alternatively, the tab Z can be designed as a bimetallic element, for example, when the sheet metal part 2 consists entirely of copper. However, it is also possible to entirely dispense with a bimetallic design and, for example, tolerate a material mismatch in a contact region.

The plug-in fuse element 1 can furthermore comprise at least one electrical filter 14. It is also possible for a heat removal cable (not shown) to be connected thereto.

In addition, a further housing (not shown) may be provided to protect against media and provide mechanical reinforcement, which extends from the cable K (for example, from the cable lug B thereof) to the tab Z of the flat conductor F1, and is fixed thereby. Such a housing can protect and reinforce the entire plug-in fuse element 1, together with the contact regions to the flat conductor F1 and to the cable K.

When an electrical current of normal intensity flows between the cable K and the flat conductor F1, the center section 5 is heated more strongly than the end sections 2 and 3, yet without fusing. The heat should be dissipated as effectively as possible so as to prevent aging of the center section 5 and material softening. This is achieved by way of the plug-in fuse element 1 in that only a very low thermal resistance is achievable between the center section 5 and the flat conductor F1, due to the flat plug-in contacting by the large-surface-area and fixed contact between the first end section 3 and the tab Z. As a result, in turn, heat can be dissipated very effectively from the center section 5 to the flat conductor F1. Due to the large-surface-area and fixed contact between the second end section 4 and the cable lug B, it is also possible to dissipate heat very effectively from the center section 5 to the cable K. This also provides a robust current conduction that is immune to interference between the cable K and the flat conductor F1.

FIG. 2 shows an oblique view of a wiring system L2 according to a second exemplary embodiment. The wiring system L2 is designed very similar to the wiring system L1 and comprises the same plug-in fuse element 1. In contrast to the wiring system L1, stripped wires D of the cable K are now attached directly to the second end section 4 of the sheet metal part 2, or to the corresponding connecting region. This may carried out, for example, by way of soldering or welding such as ultrasonic welding, or laser welding.

Figure 3:
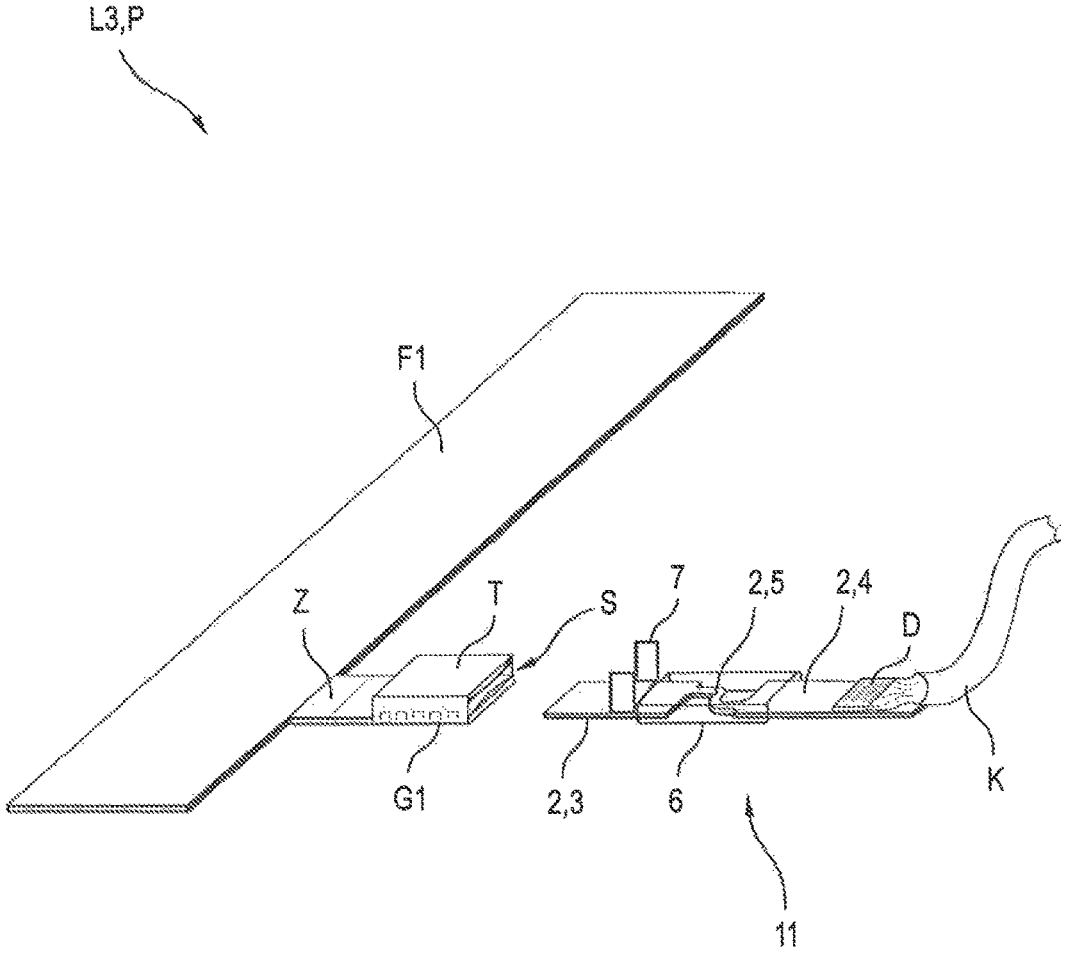
FIG. 3 shows an oblique view of a section of a wiring system of a vehicle according to a third exemplary embodiment comprising a plug-in fuse element.

FIG. 3 shows an oblique view of a section of a wiring system L3 according to a third exemplary embodiment. The wiring system L3 is designed similar to the wiring system L2 and has the same direct connection of a plug-in fuse element 11 to the cable K.

The plug-in fuse element 11 differs from the plug-in fuse element 1 by now including a heat sink 7 on the first end section 3 of the sheet metal part 2. The heat sink 7 can be a separately-produced sheet metal part, which is connected in an areal and rigid manner to the first end section 3, such as welded thereto or joined by clinching. For example, a narrow aluminum or copper strip can be bent vertically at the two end regions, so that a center region of the strip connecting the end regions is connected in an areal manner to the first end section 3 of the sheet metal part, and the end regions thereof project vertically, for example as cooling ribs or cooling fins. This can be carried out analogously on the second end section 4.

Alternatively, a multi-piece heat sink comprising cooling ribs, for example, can be provided by being formed in one piece from the first end section 3. This can take place, for example, by separating the sheet metal part 2 together with tabs extending laterally on the first end section 3, the tabs then being folded. This can be carried out analogously on the second end section 4.

Figure 4:
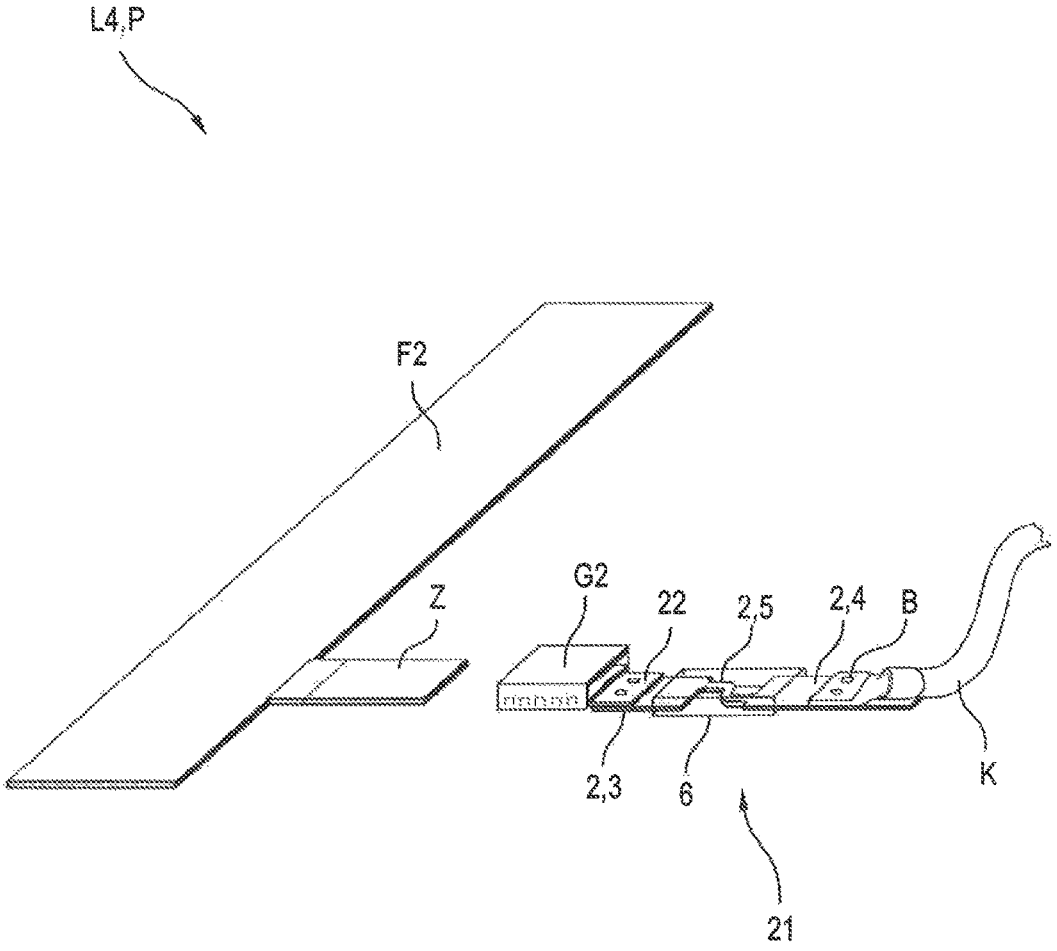
FIG. 4 shows an oblique view of a section of a wiring system of a vehicle according to a fourth exemplary embodiment comprising a plug-in fuse element.

FIG. 4 shows an oblique view of a section of a wiring system L4 according to a fourth exemplary embodiment. The wiring system L4 differs from the wiring systems L1 to L3 in that now a flat plug-in housing G2 is attached to a plug-in fuse element 21, and the tab Z of a flat conductor F2 serves as the male flat plug-in contact. The female flat plug-in contact is thus formed by a combination of the flat plug-in housing G2 and the first end section 3. The flat plug-in housing G2 is rigidly connected for this purpose to the first end section 3 of the sheet metal part 2, such as by way of press-joining, welding and the like, via a contact rail 22, which provides a contact surface for areal contacting of the tab Z.

Figure 5:
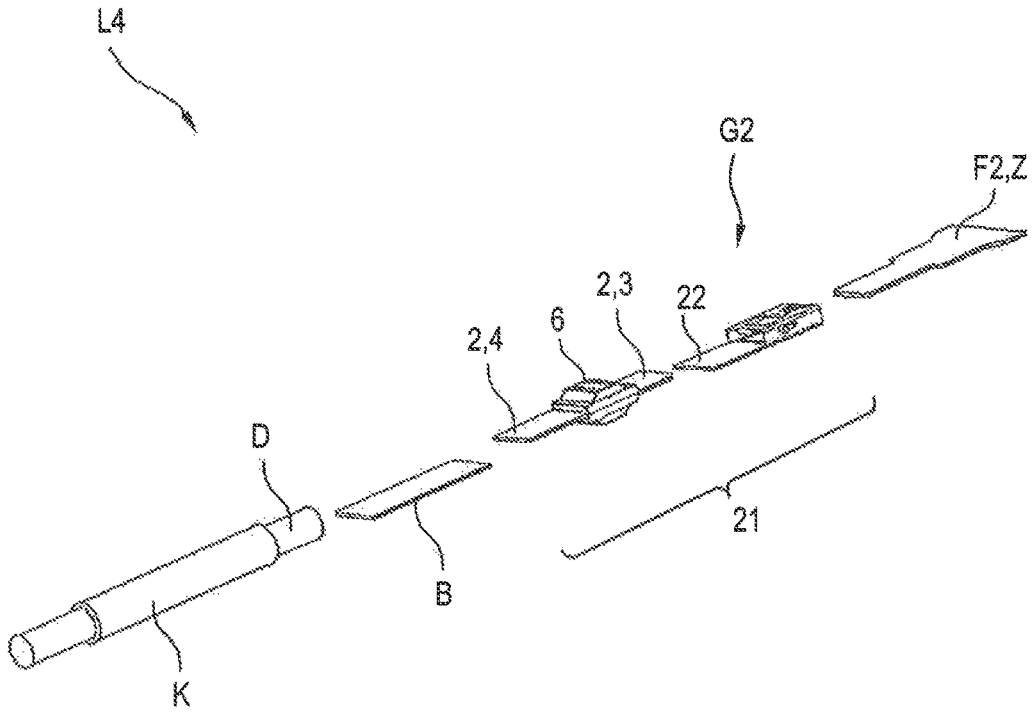
FIG. 5 shows an oblique view of an exploded illustration of a section of a wiring system according to the fourth exemplary embodiment.

FIG. 5 shows an oblique view of an exploded illustration of a section of a wiring system L4 according to the fourth exemplary embodiment.

The wires D of the cable K can be rigidly connected at the ends to a connecting element, such as the cable lug B, by way of a joining method, such as by way of crimping or welding. The cable K is thus equipped with the cable lug B, which can also be referred to as a cable assembly.

In addition, the sheet metal part 2, which has already been equipped with the housing 6, for example, can be rigidly connected to the flat plug-in housing G2 by way of joining so as to form the plug-in fuse element 21. For this purpose, the contact rail 22 of the flat plug-in housing G2 can be connected to the first end section 3 of the sheet metal part 2, for example by way of press-joining or "clinching" or "toxing" or else by way of welding and the like.

The cable lug B can thereafter be rigidly connected to the second end section 4 of the sheet metal part 2 by way of a joining method, such as press-joining, welding, screwing or crimping or the like.

The cable K can be plugged with the plug-in fuse element 21 fastened thereto onto the tab Z of the flat conductor F2. The cable can be held thereon, for example, by way of a clamping mechanism and/or by way of a screw connection and the like.

The section from the cable K to the tab Z, or at least a portion thereof, can additionally be surrounded by a further seal (not shown), such as a molded-on sealing compound or a housing. The further seal can serve as protection against media and as a mechanical reinforcement, for example.

The present disclosure is not limited to the shown exemplary embodiments.

In all wiring systems L1 to L4, the sheet metal part 2 and/or the flat conductor F1 or F2 can be designed as single-layer or as multi-layer part, such as a bimetallic ribbon or strip.

In general, "a," "an" or the like may be understood to mean a singular or a plural form, in particular within the meaning of "at least one" or "one or more" or the like, unless this is explicitly excluded, such as by the expression "exactly one" or the like.

Numerical information can also comprise exactly the indicated number as well as a typical tolerance range, unless this is explicitly excluded.

While the present disclosure is illustrated and described in detail according to the above embodiments, the present disclosure is not limited to these embodiments and additional embodiments may be implemented. Further, other embodiments and various modifications will be apparent to those skilled in the art from consideration of the specification and practice of one or more embodiments disclosed herein, without departing from the scope of the present disclosure.

LIST OF REFERENCE NUMERALS

1 Plug-in fuse element
2 Sheet metal part
3 First end section
4 Second end section
5 Center section
6 Housing
7 Heat sink
11 Plug-in fuse element
21 Plug-in fuse element
22 Contact rail
A Lead
B Cable lug
F1 Flat conductor
F2 Flat conductor
G1 Flat plug-in housing
G2 Flat plug-in housing
K Cable
L1 Wiring system
L2 Wiring system
L3 Wiring system
L4 Wiring system
P Motor vehicle
S Insertion opening of the flat plug-in housing
Z Tab

The invention claimed is:

1. A plug-in fuse element for creating an electrical coupling between a flat conductor rail of a vehicle and a stranded conductor of the vehicle, the plug-in fuse element comprising:

a strip-shaped sheet metal part extending longitudinally along a plane, the strip-shaped sheet metal part having a first end section, a second end section, and an interposed center section each extending longitudinally in a first direction along the plane, wherein:

the first end section is a flat plug-in contact electrically connected to a laterally projecting tab of the flat conductor rail when the flat plug-in contact is inserted into a slot-shaped opening of a housing supported on the projecting tab, the flat plug-in contact configured to conduct heat away from the center section to the flat conductor rail;

the second end section is a connecting region that directly connects to the stranded conductor and is configured to conduct heat away from the center section; and the center section is an overcurrent protection device.

2. The plug-in fuse element according to claim 1, wherein the first end section is formed as a tab.

3. The plug-in fuse element according to claim 1, wherein the flat plug-in contact includes a flat plug-in housing attached to the first end section by at least one areal contact.

4. The plug-in fuse element according to claim 1, further comprising:

at least one cooling projection located on the sheet metal part and configured to dissipate heat from the overcurrent protection device.

5. The plug-in fuse element according to claim 1, wherein the sheet metal part is connected to at least one heat removal line configured to dissipate heat from the overcurrent protection device, the heat removal line being separate from the flat conductor rail and stranded conductor of the vehicle.

6. The plug-in fuse element according to claim 1, wherein the center section includes a cross-sectional taper formed as a fusible cutout.

7. The plug-in fuse element according to claim 1, wherein the center section includes at least one further component forming the overcurrent protection device.

8. The plug-in fuse element according to claim 1, further comprising:

a thermally conductive housing surrounding at least the center section.

9. The plug-in fuse element according to claim 1, wherein:

the strip-shaped sheet metal part includes two outer layers, the first outer layer made of a different metal from the second outer layer;

a contact region of the flat plug-in contact is formed by one of the outer layers; and the connecting region is formed by the other outer layer.

10. The plug-in fuse element according to claim 1, wherein the plug-in fuse element includes at least one electrical filter, the electric filter reducing interfering magnetic or electric fields.

11. The plug-in fuse element according to claim 1, further comprising:

a stranded conductor having at least one end connected to the connecting region of the plug-in fuse element.

12. The plug-in fuse element according to claim 11, wherein the stranded conductor further comprises:

at least one wire connected to a cable lug, wherein the cable lug is connected via an areal contact to the second end section of the plug-in fuse element.

13. The plug-in fuse element according to claim 11, wherein the stranded conductor further comprises:

at least one wire directly connected to the second end section of the plug-in fuse element.

14. A wiring system for a vehicle, comprising:

a strip-shaped flat conductor rail extending longitudinally in a first direction within the vehicle, the flat conductor rail having a laterally projecting tab extending in a second direction perpendicular to the first direction, wherein the projecting tab supports a housing having a slot-shaped opening for establishing an electrical connection;

a plug-in fuse element comprising a strip-shaped sheet metal part extending longitudinally in the second direction along a plane, the strip-shaped sheet metal part having a first end section, a second end section, and an interposed center section each extending longitudinally in the second direction along the plane, wherein:

the first end section is a flat plug-in contact electrically connected to the laterally projecting tab when the flat plug-in contact is inserted into the slot-shaped opening of the housing, wherein the flat plug-in contact is configured to conduct heat away from the center section to the flat conductor rail;

the second end section is a connecting region configured to conduct heat away from the center section; and the center section is an overcurrent protection device; and a stranded conductor having at least one end directly connected to the connecting region of the plug-in fuse element;

wherein the at least one end of the stranded conductor is connected, via the flat plug-in contact of the plug-in fuse element connected to the laterally projecting tab, to the strip-shaped flat conductor.

15. The wiring system according to claim 14, further comprising:

at least one cooling projection located on the strip-shaped sheet metal part of the plug-in fuse element, wherein the cooling projection is configured to dissipate heat from the overcurrent protection device.

16. The wiring system according to claim 14, wherein the strip-shaped sheet metal part of the plug-in fuse element is connected to at least one heat removal line configured to dissipate heat from the overcurrent protection device, the heat removal line being separate from the flat conductor rail and stranded conductor of the vehicle.

17. The wiring system according to claim 14, wherein the plug-in fuse element further comprises:

a thermally conductive housing surrounding at least the center section.

18. The wiring system according to claim 14, wherein:

the strip-shaped sheet metal part includes two outer layers, the first outer layer made of a different metal from the second outer layer;

a contact region of the flat plug-in contact is formed by one of the outer layers; and the connecting region is formed by the other outer layer.

19. The wiring system according to claim 14, wherein the stranded conductor further comprises:

at least one wire connected to a cable lug, wherein the cable lug is connected via an areal contact to the second end section of the plug-in fuse element.

20. A wiring system for a vehicle, comprising:

a flat conductor rail extending longitudinally in a first direction along a vehicle body floor from a front end of the vehicle to a rear end of the vehicle, the flat conductor rail having a laterally projecting tab extending in a second direction perpendicular to the first direction, wherein the projecting tab supports a housing having a slot-shaped opening for establishing an electrical connection;

a plug-in fuse element comprising a strip-shaped sheet metal part extending longitudinally in the second direction along a plane, the strip-shaped sheet metal part having a first end section, a second end section, and an interposed center section each extending longitudinally in the second direction along the plane, wherein:

the first end section is a flat plug-in contact electrically connected to the laterally projecting tab when the flat plug-in contact is inserted into the slot-shaped opening of the housing, wherein the flat plug-in contact is configured to conduct heat away from the center section to the flat conductor rail;

the second end section is a connecting region configured to conduct heat away from the center section; and the center section is an overcurrent protection device; and a stranded conductor having at least one end directly connected to the connecting region of the plug-in fuse element;

wherein the at least one end of the stranded conductor is connected, via the flat plug-in contact of the plug-in fuse element connected to the laterally projecting tab, to the flat conductor.

* * * * *